US008131174B2

(12) United States Patent
Ando

(10) Patent No.: US 8,131,174 B2
(45) Date of Patent: Mar. 6, 2012

(54) FIXING DEVICE, IMAGE FORMING APPARATUS, FIXING METHOD AND IMAGE FORMING METHOD

(75) Inventor: Chikara Ando, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 367 days.

(21) Appl. No.: 12/206,329

(22) Filed: Sep. 8, 2008

(65) Prior Publication Data

US 2009/0226200 A1 Sep. 10, 2009

(30) Foreign Application Priority Data

Mar. 4, 2008 (JP) ..... 2008-053360

(51) Int. Cl.
*G03G 15/20* (2006.01)
*G03G 15/16* (2006.01)
*G03G 21/20* (2006.01)

(52) U.S. Cl. ..... 399/69; 399/92; 399/122; 399/329

(58) Field of Classification Search ..... 399/69
See application file for complete search history.

(56) References Cited

U.S. PATENT DOCUMENTS

| | | | | |
|---|---|---|---|---|
| 4,885,603 | A | 12/1989 | Tomizawa et al. | 355/30 |
| 4,981,433 | A | 1/1991 | Matsumoto et al. | 432/59 |
| 6,006,052 | A * | 12/1999 | Kamimura et al. | 399/69 |
| 7,747,195 | B2 | 6/2010 | Yoshino et al. | |
| 2007/0025750 | A1 | 2/2007 | Ando | 399/67 |
| 2007/0048042 | A1* | 3/2007 | Uehara et al. | 399/329 |
| 2007/0059010 | A1* | 3/2007 | Arimoto et al. | 399/69 |
| 2007/0059021 | A1 | 3/2007 | Hanashi et al. | 399/92 |
| 2007/0166084 | A1 | 7/2007 | Yoshino et al. | |

FOREIGN PATENT DOCUMENTS

| | | |
|---|---|---|
| CN | 101004581 | 7/2007 |
| EP | 0365 251 | 4/1990 |
| JP | 11-143285 | 5/1999 |
| JP | 2001-318542 | 11/2001 |
| JP | 2001318542 A * | 11/2001 |
| JP | 2003-098899 | 4/2003 |
| JP | 2007-057761 | 3/2007 |
| JP | 2007-086538 | 4/2007 |

* cited by examiner

*Primary Examiner* — David Gray
*Assistant Examiner* — David Bolduc
(74) *Attorney, Agent, or Firm* — Morgan, Lewis & Bockius LLP

(57) ABSTRACT

The fixing device is provided with: a fixing member that has a rotating member which rotates and a heat source which heats the rotating member; a pressure member that is driven to rotate while pressing the fixing member, and that forms a nip portion where a recording medium passes, between the fixing member and the pressure member; a separation unit that separates the fixing member and the pressure member from each other; and a cooling unit that cools a face of the pressure member separated by the separating unit. The face is opposed to the fixing member.

17 Claims, 4 Drawing Sheets

61
610
611
62
625
74
75
751
73
72
71
70
G
F
I
H

FIXING DEVICE, IMAGE FORMING APPARATUS, FIXING METHOD AND IMAGE FORMING METHOD

CROSS REFERENCE TO RELATED APPLICATIONS

This application is based on and claims priority under 35 USC §119 from Japanese Patent Application No. 2008-053360 filed Mar. 4, 2008.

BACKGROUND

1. Technical Field

The present invention relates to a fixing device, an image forming apparatus, a fixing method and an image forming method. More specifically, it relates to a fixing device included in a copy machine, a printer or the like with an electrophotographic method, and the like.

2. Related Art

Conventionally, in an image forming apparatus with an electrophotographic method, a toner image formed on a recording medium such as a paper sheet is fixed on the recording medium by using a heat and pressure fixing method, in general. As the heat and pressure fixing method, a method (roll nip method) in which an unfixed toner image is heated and pressed at a nip portion formed between a fixing roll incorporating a heater and a pressure roll to be fixed on the recording medium, and a method (belt nip method) in which a pressure pad presses a recording medium against the fixing roll from an inner side of an endless belt to form a nip portion are exemplified.

In the heat and pressure fixing method, a high quality image without unevenness is considered to be obtained by uniformly maintaining surface temperatures of the fixing roll and the pressure roll. Thus, there has been developed a technique for uniformly maintaining the surface temperatures of the fixing roll and the like even when, for example, the fixing roll and the pressure roll remains in a state where they are heated and pressed without rotation (a stand-by state or a stand-by mode).

SUMMARY

According to an aspect of the invention, there is provided a fixing device including: a fixing member that has a rotating member which rotates and a heat source which heats the rotating member; a pressure member that is driven to rotate while pressing the fixing member, and that forms a nip portion where a recording medium passes, between the fixing member and the pressure member; a separation unit that separates the fixing member and the pressure member from each other; and a cooling unit that cools a face of the pressure member separated by the separating unit. The face is opposed to the fixing member.

BRIEF DESCRIPTION OF THE DRAWINGS

Exemplary embodiment (s) of the present invention will be described in detail based on the following figures, wherein.

DETAILED DESCRIPTION

Hereinafter, a description will be given of exemplary embodiments to carry out the present invention. It should be noted that the present invention is not limited to the following exemplary embodiments, but may be embodied in several forms without departing from the gist thereof. In addition, the attached drawings are for explaining the present exemplary embodiments, and they do not show the real size.

(Image Forming Apparatus)

Figure 1:
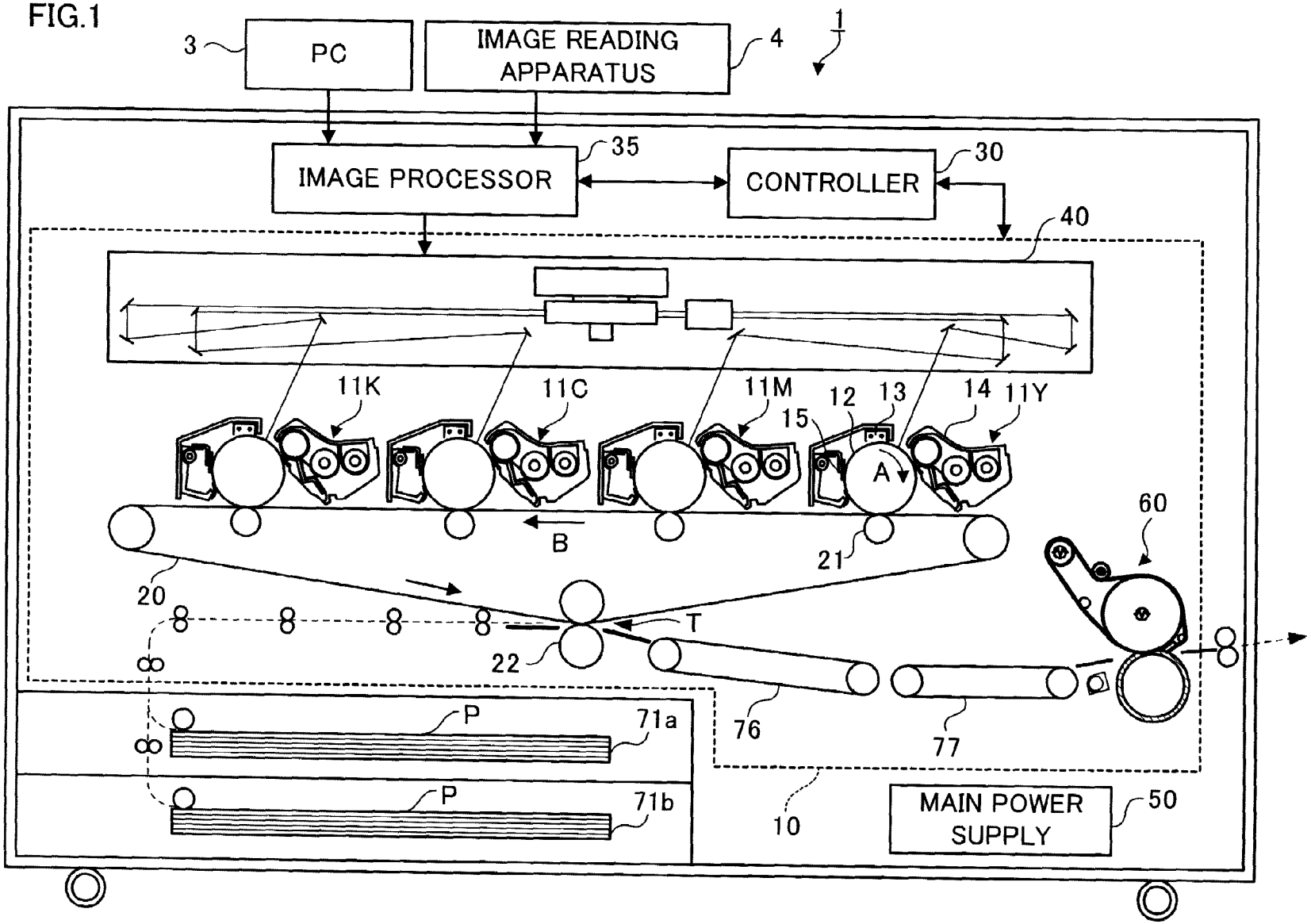
FIG. 1 is a diagram showing an entire configuration of an image forming apparatus to which the exemplary embodiments are applied.

FIG. 1 is a diagram showing an entire configuration of an image forming apparatus 1 to which the exemplary embodiments are applied. The image forming apparatus 1 shown in FIG. 1 is a color printer with a so-called tandem type. The image forming apparatus 1 is provided with an image forming processor 10 that forms an image in accordance with respective color image data, a controller 30 that controls operation of the entire image forming apparatus 1, an image processor 35 that is connected to an external apparatus such as a personal computer (PC) 3 and an image reading apparatus 4, and performs a certain image processing on the received image data from these apparatuses, and a main power supply 50 that supplies electric power to respective units.

The image forming processor 10 is provided with four image forming units 11Y, 11M, 11C and 11K (also collectively referred to as "image forming units 11") that is an example of a toner image forming unit arranged in parallel at a certain distance. Each of the image forming units 11 is provided with a photoconductor drum 12 that is an example of an image carrier that forms an electrostatic latent image and holds a toner image, a charging device 13 that uniformly charges a surface of the photoconductor drum 12 at a certain potential, a developing device 14 that develops the electrostatic latent image formed on the photoconductor drum 12, and a cleaner 15 that cleans the surface of the photoconductor drum 12 after transfer.

Each of the image forming units 11 is configured in a substantially similar manner, except toner contained in the developing device 14. The image forming units 11 form yellow (Y), magenta (M), cyan (C) and black (K) toner images, respectively.

Furthermore, the image forming processor 10 is provided with a laser exposure device 40 that exposes the photoconductor drums 12 respectively disposed in the image forming units 11, an intermediate transfer belt 20 onto which respective color toner images formed on the photoconductor drums 12 of the image forming units 11 are superimposingly transferred, primary transfer rolls 21 that each sequentially transfer (primarily transfer) each color toner image formed in each of the image forming units 11 onto the intermediate transfer belt 20, a secondary transfer roll 22 that collectively transfers (secondarily transfers), onto a paper sheet P as a recording medium (a recording paper), respective color toner images superimposingly transferred onto the intermediate transfer belt 20, and a fixing device 60 as an example of a fixing unit (fixing device) that fixes the secondarily-transferred respective color toner images onto the paper sheet P. It should be noted that, in the image forming apparatus 1 of the present exemplary embodiments, the intermediate transfer belt 20, the primary transfer roll 21, and the secondary transfer roll 22 configures a transfer unit.

In the image forming apparatus 1 of the present exemplary embodiments, image data inputted from the PC 3 or the image reading apparatus 4 is subjected to a certain image processing by the image processor 35, and then the resultant data are transmitted to the respective image forming units 11 via an interface that is not shown in the figure. Then, in, for example, the image forming unit 11Y that forms a yellow (y) toner image, while rotating in an arrow A direction, the photoconductor drum 12 is uniformly charged at a certain potential by the charging device 13, and is scanned and exposed by the laser exposure device 40 with a laser light which is controlled on the basis of the image data transmitted from the image processor 35. Accordingly, on the photoconductor drum 12, an electrostatic latent image for a yellow (Y) image is formed. Then, the electrostatic latent image formed on the photoconductor drum 12 is developed by the developing device 14, and a yellow (Y) toner image is formed on the photoconductor drum 12. Similarly, in the image forming units 11M, 11C and 11K, magenta (M), cyan (C) and black (K) toner images are formed, respectively.

The respective color toner images formed in the image forming units 11 is electrostatically attracted, by the primary transfer roll 21, onto the intermediate transfer belt 20 moving in an arrow B direction, in sequence, and superimposed toner images that are obtained by superimposing the respective color toner images are formed. The superimposed toner images on the intermediate transfer belt 20 are transported to a region (a secondary transfer portion T) where the secondary transfer roll 22 is arranged in accordance with movement of the intermediate transfer belt 20. When the superimposed toner images are transported to the secondary transfer portion T, a paper sheet P is supplied to the secondary transfer portion T from any one of paper sheet holders 71*a* and 71*b* that has been selected, at right timing when the superimposed toner images are transported to the secondary transfer portion T. Then, the superimposed toner images are collectively and electrostatically transferred onto the paper sheet P that has been transported, by action of a transfer electric field formed at the secondary transfer portion T by the secondary transfer roll 22.

Subsequently, the paper sheet P on which the superimposed toner images have been electrostatically transferred is peeled from the intermediate transfer belt 20, and is transported to the fixing device 60 by transportation belts 76 and 77. The toner images on the paper sheet P transported to the fixing device 60 are subjected to a fixing processing with heat and pressure by the fixing device 60 to be fixed on the paper sheet P. Then, the paper sheet P on which a fixed image has been formed is transported to an outputted paper sheet stacking part (not shown in the figure) provided in an output unit of the image forming apparatus 1.

As described above, image formation in the image forming apparatus 1 is performed by repeating the image formation for the number of cycles same as the number of printout copies.

(Fixing Device)

Next, a description will be given of the fixing device 60.

Figure 2:
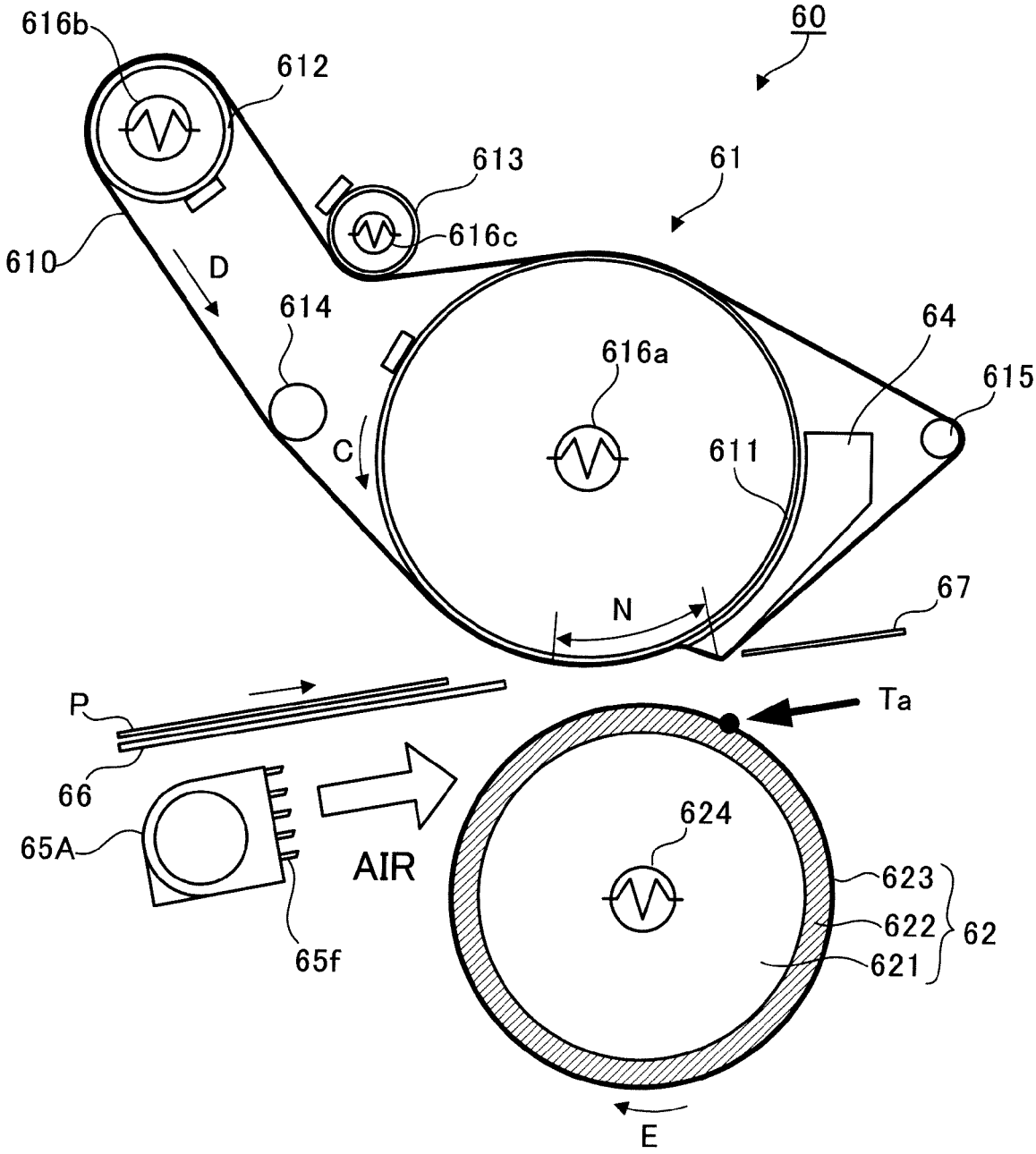
FIG. 2 is a cross-sectional view showing a schematic configuration of the fixing device of the first exemplary embodiment.

FIG. 2 is a cross-sectional view showing a schematic configuration of the fixing device 60 of the first exemplary embodiment. The fixing device 60 is provided with a fixing belt module (fixing member) 61 as a main part, and a pressure roll (pressure member) 62 that is driven to rotate while pressing the fixing belt module 61, and that forms a nip portion N where a paper sheet P (a recording medium) passes, with the fixing belt module 61 at a portion in between, also as a main part.

In addition, the fixing device 60 has a separation unit (not shown in the figure) that separates the pressure roll 62 and the fixing belt module 61 from each other, and a blower (a cooling unit) 65A that cools a face of the pressure roll 62, which is opposed to the fixing belt module 61 (hereinafter, referred to as "a portion opposed to the fixing member" in some cases) in a state where the pressure roll 62 and the fixing belt module 61 are separated from each other.

The fixing belt module 61 is provided with a fixing belt (endless belt) 610, a fixing roll (rotating member) 611 that rotates while stretching the fixing belt 610, and that is formed in a cylindrical shape, and a tension roll 612 that stretches the fixing belt 610 from an inner side thereof. In addition, the fixing belt module 61 is provided with a heat roll (heat member) 613 that rotates while stretching the fixing belt 610 from an outer side thereof, and that heats the fixing belt 610, and an attitude correction roll 614 that corrects an attitude of the fixing belt 610 in a portion between the fixing roll 611 and the tension roll 612.

Further, the fixing belt module 61 is provided with a peeling pad (peeling member) 64 that is arranged so as to press an outer surface of the fixing belt 610 to the pressure roll 62 on a downstream side of a portion where the fixing roll 611 and the pressure roll 62 are pressed against each other.

Moreover, the fixing belt module 61 is provided with an idler roll 615 that stretches the fixing belt 610 on a downstream side of the nip portion N.

The fixing belt 610 is a flexible endless belt. The fixing belt 610 is formed of a base layer made of polyimide or the like with a thickness of approximately 80 μm, an elastic body layer stacked on a surface side (outer circumferential face side) of the base layer, and made of silicone rubber or the like with a thickness of approximately 50 μm, and a release layer that covers the elastic body layer and that is made of fluoropolymer (for example, tetrafluoroethylene-perfluoroalkylvinylether copolymer (PFA) or the like) with a thickness of approximately 30 μm. The fixing belt 610 moves (rotates) in an arrow D direction in accordance with the rotation of the fixing roll 611.

The fixing roll 611 receives driving force from a certain driving unit (not shown in the figure), and rotates in an arrow C direction. In addition, inside the fixing roll 611, a heater (heat source) 616*a* is arranged.

The tension roll 612 is a cylindrical roll and has a heater 616*b* therein, as a heat source. The tension roll 612 has not only a function for stretching the fixing belt 610 but also a function for heating the fixing belt 610 from the inner circumferential face side. In addition, at both edge portions of the tension roll 612, spring members (not shown in the figure) that press the fixing belt 610 outward are disposed and apply tension to the entire fixing belt 610.

The heat roll 613 is a cylindrical roll and has a heater 616*c* therein, as a heat source. Accordingly, the heat roll 613 has not only a function for stretching the fixing belt 610 but also a function for heating the fixing belt 610 from an outer circumferential face side. In the first exemplary embodiment, a configuration is adopted in which the heat roll 613, the tension roll 612 and the fixing roll 611 heat the fixing belt 610.

The pressure roll 62 has a cylindrical roll 621 as a base. Further, the pressure roll 62 forms a soft roll by sequentially stacking an elastic layer 622 and a release layer 623 from the base side. In addition, the pressure roll 62 is attached so as to press the fixing belt module 61. The pressure roll 62 is driven by the fixing roll 611 so as to rotate in an arrow E direction in accordance with the rotation of the fixing roll 611 of the fixing belt module 61 in the arrow C direction. Moreover, the pressure roll 62 is provided with a heater 624 therein, as a heat source, and is heated at a certain temperature by the heater 624.

The peeling pad 64 is arranged near the fixing roll 611 while having a curvature which is substantially the same as that of the outer circumferential face of the fixing roll 611 formed in a cylindrical shape. The peeling pad 64 of the first exemplary embodiment is, for example, a block member made of metal such as stainless steel (SUS), or a rigid body such as resin, and a cross section thereof is in an arc-like shape. Moreover, the peeling pad 64 is attached so as to uniformly press, with a certain load (for example, 98 N (10 kgf)), a certain width region of the pressure roll 62 (for example, the width of 2 mm to 10 mm along a moving direction of the fixing belt 610) through the fixing belt 610.

In the fixing device 60 shown in FIG. 2, when the fixing belt module 61 is not rotated, and left under the pressure by the pressure roll 62, the fixing roll 611 and the nip portion N of the fixing belt 610 may be deformed permanently, and the deformation occasionally causes image defects. On this account, a separation unit that separates the pressure roll 62 and the fixing belt module 61 from each other is provided in the first exemplary embodiment.

Figures 3A, 3B:
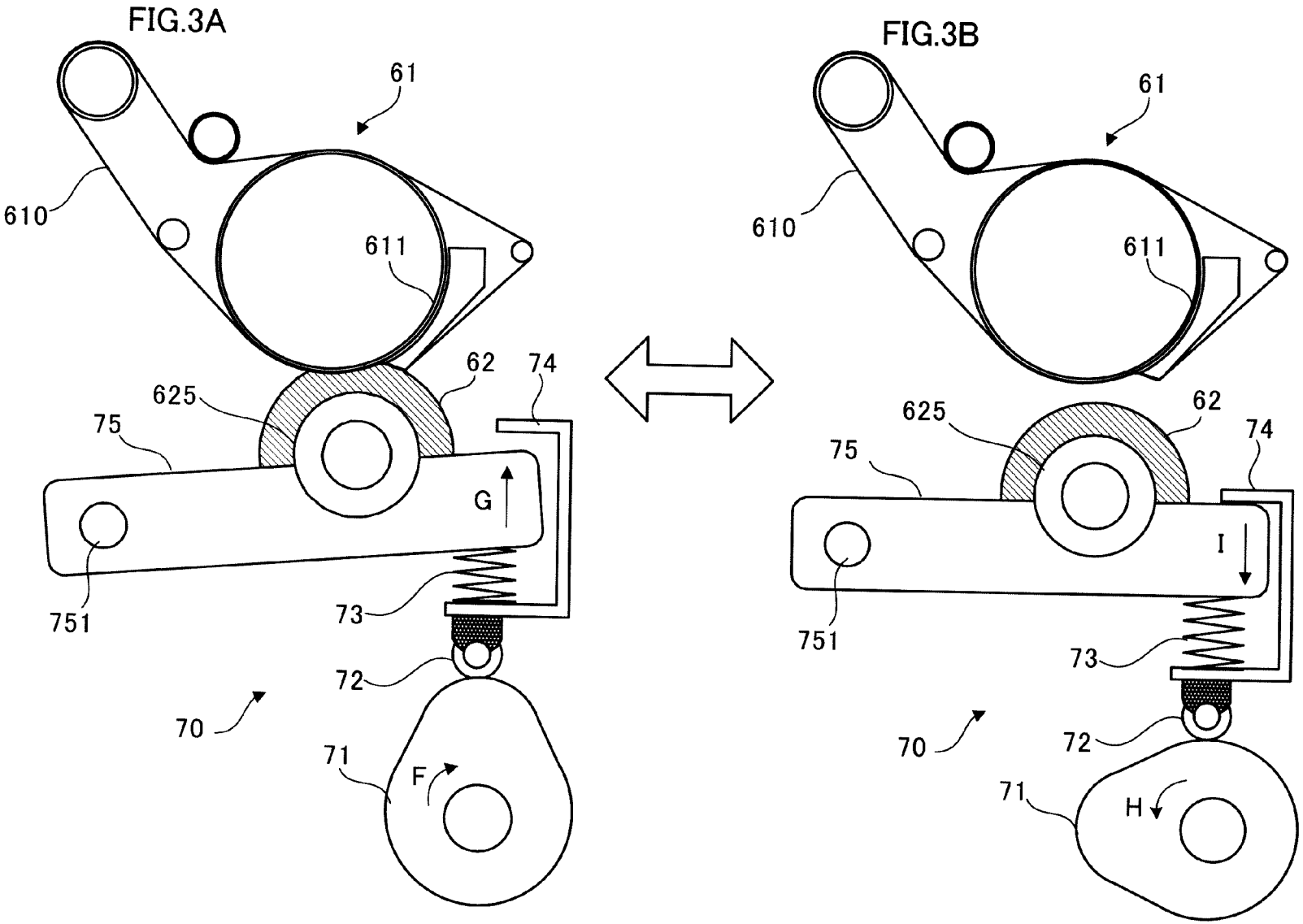
FIGS. 3A and 3B are views for explaining a cam mechanism as an example of the separation unit.

FIGS. 3A and 3B are views for explaining a cam mechanism 70 as an example of the separation unit. As shown in FIGS. 3A and 3B, the cam mechanism 70 is provided with, as its main parts, a disk cam 71 that rotates eccentrically by using a certain drive apparatus (not shown in the figure), a roller 72 as a contactor that is in contact with the disk cam 71 and rotates, a spring 73 as a follower that is attached to the roller 72 and converts the eccentric rotational motion of the disk cam 71 into a straight line motion, and a swing member 75 that is attached so as to swing with respect to a bearing 625 of the pressure roll 62. In addition, an end portion of the swing member 75 and the spring 73 are contained in a containing part 74.

As shown in FIG. 3A, at the time of the fixing operation, while the roller 72 and the spring 73 are pushed upward by the rotational motion of the disk cam 71 in an arrow F direction, the end portion of the swing member 75 is pushed upward in an arrow G direction with an attachment part 751 as a center of the swing. Thereby, the pressure roll 62 attached to the swing member 75 is pressed to the fixing belt module 61.

Next, as shown in FIG. 3B, when the fixing operation is finished, while the load for pushing the roller 72 and the spring 73 upward is released by the rotational motion of the disk cam 71 in an arrow H direction, the end portion of the swing member 75 goes down in an arrow I direction with the attachment part 751 as a center of the swing. Thereby, the pressure roll 62 attached to the swing member 75 is separated from the fixing belt module 61.

Next, a description will be given of the blower 65A as an example of a cooling unit.

The fixing device 60 to which the first exemplary embodiment is applied has the blower 65A for cooling the face of the pressure roll 62 (the portion opposed to the fixing member), which is opposed to the fixing belt module 61.

The blower 65A is not limited specifically, as long as it may blow cooling air (air) to the pressure roll 62. In the first exemplary embodiment, a lateral flow blower (cross flow fan) is utilized as the blower 65A. Here, for example, the lateral flow blowers that are widely adopted in air conditioners and the like may be used for this purpose. Normally, such a lateral flow blower has plural fan bodies, each of which is composed of plural blades. The both ends of the blades are held by a disk-shaped end plate, and the cross section of the blade is an arc shape. Further, the plural fan bodies are connected in an axial direction. Furthermore, by the blades, the lateral flow blower converts the wind flow that is introduced from the axial direction of the rotating fan body into one directional flow having a plane expansion flowing forward.

As shown in FIG. 2, the blower 65A is provided under a paper sheet insertion guide plate 66 for supplying a paper sheet P to the nip portion N, and, when the pressure roll 62 and the fixing belt module 61 are separated from each other, the blower 65A blows cooling air (air) from an upstream side of the portion where the nip portion N is formed, to the portion opposed to the fixing member of the pressure roll 62. After the cooling air (air) cools the portion opposed to the fixing member of the pressure roll 62, the cooling air goes through a portion under a paper sheet exit guide plate 67 for transporting the paper sheet P that is outputted from the nip portion N.

That is, the pressure roll 62 stands by in a stopped state, after it is separated from the fixing belt module 61, because the pressure roll 62 is not provided with a rotating drive mechanism. Therefore, the surface temperature of the portion opposed to the fixing member of the pressure roll 62 become higher than other portions, by the heat radiation from the fixing belt 610 and the fixing roll 611 having the heat source, and the temperature distribution occurs on the surface of the pressure roll 62 in the circumferential direction. At this moment, the high temperature region is cooled by blowing the cooling air (Air) from the blower 65A, and the temperature distribution that has occurred on the surface of the pressure roll 62 is averaged.

By providing the blower 65A, the high temperature region of the pressure roll 62 may be easily cooled, without having a rotating drive mechanism for rotating the pressure roll 62. Therefore, space-saving inside the apparatus and cost reduction may be attained.

It should be noted that, a position for arranging the blower 65A is not limited in particular, as long as the blower 65A does not cool the fixing belt module 61 when the pressure roll 62 is separated from the fixing belt module 61 and the blower 65A is located at a position where air is blown to the portion opposed to the fixing member of the pressure roll 62. In the first exemplary embodiment, as shown in FIG. 2, it is preferable that the blower 65A is provided under the paper sheet insertion guide plate 66, and the cooling air (air) is blown from the upstream side of the portion where the nip portion N is formed, to the portion opposed to the fixing member of the pressure roll 62.

In the first exemplary embodiment, the operation and stop of the blower 65A that is a cooling device is controlled on the basis of the temperature of the portion opposed to the fixing member of the pressure roll 62. At this point, the temperature of the portion opposed to the fixing member of the pressure roll 62 is measured, as shown in FIG. 2, at a roll temperature measurement position Ta that is provided on the downstream side of the portion where the nip portion N is formed, of the pressure roll 62, by, for example, a non-contact thermometer such as an infrared radiation thermometer or the like.

That is, in the first exemplary embodiment, the image defects and the image gloss changes are suppressed by cooling the high temperature region (the portion opposed to the fixing member) of the pressure roll 62 with the blower 65A, and by averaging the temperature distribution. On the other hand, when the pressure roll 62 is excessively cooled, insufficient fixation (cold offset and the like) tends to occur, and accordingly, it is necessary to precisely control the temperature changes of the pressure roll 62.

Therefore, the occurrence of the insufficient fixation is prevented by controlling the cooling performance of the blower 65A on the basis of the temperature of the portion opposed to the fixing member of the pressure roll 62. At this point, the cooling performance of the blower 65A is adjusted by the air volume (including air volume=0) of the cooling air (air) blown from the blower 65A.

As shown in FIG. 2, in the first exemplary embodiment, the blower 65A is set so as to blow the cooling air (air) onto the surface of the portion opposed to the fixing member of the pressure roll 62, when the fixing belt module 61 and the pressure roll 62 are separated from each other, that is, when the fixing operation by the fixing device 60 is stopped.

Here, at the time of the fixing operation by the fixing device 60, the blower 65A stops blowing air so that the cooling air (air) is not blown toward the paper sheet P supplied to the rotating fixing belt 610 and the nip portion N. By stopping blowing air from the blower 65A at the time of the fixing operation, for example, the occurrence of the insufficient fixation associating with the temperature fall of the fixing belt 610 is prevented. Furthermore, the attribute change of the paper sheet P supplied to the nip portion N, which is caused by blowing air, is suppressed, and the paper jam (jam) is prevented.

(Change Unit for Changing a Blowing Direction)

Furthermore, in the first exemplary embodiment, it is preferable that the blower 65A is provided with a change unit for changing the blowing direction of the cooling air (air) blown from the blower 65A in order to prevent the cooling air (air) from being blown toward the paper sheet P supplied to the rotating fixing belt 610 and the nip portion N at the time of the fixing operation by the fixing device 60.

As the change unit for changing the blowing direction, for example, plural fins 65f that are provided at an air outlet of the blower 65A and that are movable to swing by using a reciprocating movement into which a shift of a solenoid or rotation of a motor has been converted is exemplified. Alternatively, as the changing unit, for example, the air outlet of the blower 65A whose angle is changeable within a certain range by using rotation of the motor or the like is exemplified.

It should be noted that, the operation and stop of the blower 65A, air volume of the cooling air (air) and the change of the blowing direction of the cooling air (air) are performed by the controller 30 (refer to FIG. 1) that is provided in the image forming apparatus 1.

Next, a description will be given of a second exemplary embodiment for the fixing device.

Figure 4:
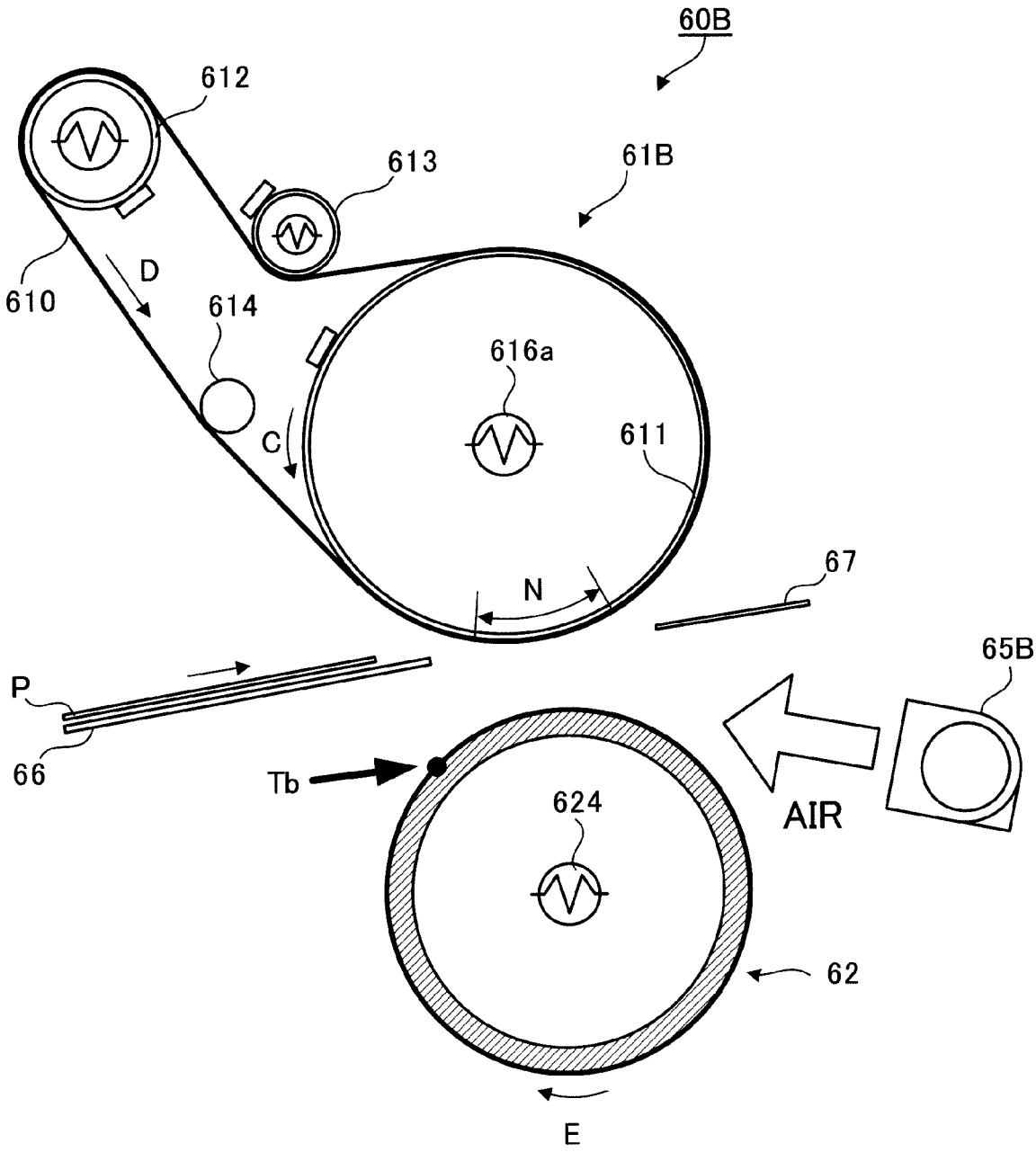
FIG. 4 is a cross-sectional view showing a schematic configuration of a fixing device of the second exemplary embodiment.

FIG. 4 is a cross-sectional view showing a schematic configuration of a fixing device 60B of the second exemplary embodiment. For the same configurations as those of the first exemplary embodiment having been already shown in FIG. 2, the same reference numerals are used, and the description thereof will be omitted.

As shown in FIG. 4, similarly to the first exemplary embodiment, the fixing device 60B of the second exemplary embodiment is provided with a fixing belt module 61B and the pressure roll 62 that forms a nip portion N where a paper sheet P passes, as main parts. In addition, in the fixing device 60B, a blower 65B is installed. The blower 65B cools the portion opposed to the fixing member of the pressure roll 62 when the pressure roll 62 and the fixing belt module 61B are separated from each other.

As shown in FIG. 4, the blower 65B is provided under the paper sheet exit guide plate 67 for transporting a paper sheet P outputted from the nip portion N.

It should be noted that a position where the blower 65B is located is not limited in particular, as long as the blower 65A is located at a position where air is blown to the portion opposed to the fixing member of the pressure roll 62, similarly to the first exemplary embodiment. In the second exemplary embodiment, the fixing belt module 61B is not provided with the peeling pad 64 (refer to FIG. 2) on the downstream side of the portion where the nip portion N is formed. Therefore, as shown in FIG. 4, the blower 65B may be provided under the paper sheet exit guide plate 67.

The blower 65B blows cooling air (air) from the downstream side of the portion where the nip portion N is formed, to the portion opposed to the fixing member of the pressure roll 62, when the pressure roll 62 and the fixing belt module 61B are separated from each other. After the cooling air (air) cools the portion opposed to the fixing member of the pressure roll 62, the cooling air goes through a portion under the paper sheet insertion guide plate 66 for supplying a paper sheet P to the nip portion N.

In the second exemplary embodiment, the operation and stop of the blower 65B is controlled on the basis of the temperature of the portion opposed to the fixing member of the pressure roll 62, similarly to the first exemplary embodiment. Here, the temperature of the portion opposed to the fixing member of the pressure roll 62 is measured, as shown in FIG. 4, at a roll temperature measurement position Tb provided on the upstream side of the portion of the pressure roll 62, where the nip portion N is formed.

EXAMPLE

Hereinafter, the present invention will be described more specifically on the basis of an example. It should be noted that the present invention is not limited to the following example as long as the gist thereof is not deviated.

EXAMPLE

As mentioned above, in the fixing device 60 shown in FIG. 2, the blower 65A (a cross flow fan MFD930B-24 manufactured by Oriental Motor Co., Ltd.) that cools the portion opposed to the fixing member of the pressure roll 62 over the entire width area in the axial direction is installed.

Next, the fixing device 60 is operated in the following setup conditions, and relations between the temperature of the portion opposed to the fixing member of the pressure roll 62 and the occurrence of the image defects are examined.

It should be noted that, the temperature of the portion opposed to the fixing member of the pressure roll 62 is measured, as shown in FIG. 2, by use of a non-contact thermometer (an infrared radiation thermometer), at the roll temperature measurement position Ta.

The operating condition of the fixing device 60 is as follows:

(1) Type of a paper sheet P: OK TOPKOTE 104

(2) Process speed: 400 mm/sec (3) Specification of the fixing belt 610: diameter Φ168 mm, PFA (a thickness of 30 μm)/silicone rubber (a thickness of 160 μm)/polyimide (a thickness of 90 μm)

(4) Specification of the fixing roll 611: diameter Φ100 mm, aluminum/PFA surface layer (a thickness of 300 μm)

(5) Specification of the pressure roll 62: diameter Φ65 mm, silicone rubber intermediate layer (a thickness of 10 mm)/PFA surface layer (a thickness of 100 μm)

(6) Load on the nip portion N: approximately $1.7\times10^3$ N (180 kgf)

As a result of operating the fixing device 60 under the conditions mentioned above, the image defects do not occur in the case where the temperature of the portion opposed to the fixing member of the pressure roll 62 is cooled below 80° C. by the cooling air (air) blown from the blower 65A when the fixing belt 610 and the pressure roll 62 are separated from each other.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing member that has a rotating member which rotates and a heat source which heats the rotating member;

a pressure member that is driven to rotate while pressing the fixing member, and that forms a nip portion where a recording medium passes, between the fixing member and the pressure member;

a separation unit that separates the fixing member and the pressure member from each other; and a cooling unit that blows cooling air to a face of the pressure member separated by the separating unit when the recording medium is released from the nip portion and a fixing operation is stopped, the face being opposed to the fixing member, and the cooling unit blowing the cooling air from the upstream side of a portion where the nip portion is formed, wherein the cooling unit further comprises a change unit that changes a blowing direction of the cooling air at the time of the fixing operation.

2. The fixing device according to claim 1, wherein the cooling unit is a blower that blows air.

3. The fixing device according to claim 1, further comprising a controller that controls the cooling unit on the basis of temperature of the face of the pressure member, the face being opposed to the fixing member.

4. The fixing device according to claim 1, wherein the cooling unit is a blower that blows air, and the fixing device further comprises a controller that controls air blown from the blower of the cooling unit on the basis of temperature of the face of the pressure member, the face being opposed to the fixing member.

5. The fixing device according to claim 3, wherein the controller controls so as to stop blowing air from a blower at the time of a fixing operation.

6. The fixing device according to claim 1, wherein the fixing member comprises an endless belt that is stretched by the rotating member; and a heat member that rotates while stretching the endless belt together with the rotating member, and that heats the endless belt.

7. The fixing device according to claim 6, wherein the fixing member further comprises a peeling member that is arranged so that an outer surface of the endless belt is pressed against the pressure member on a downstream side of a portion where the rotating member and the pressure member are pressed against each other.

8. An image forming apparatus comprising:

a toner image forming unit that forms a toner image;

a transfer unit that transfers the toner image onto a recording medium; and a fixing unit that fixes the toner image transferred onto the recording medium, onto the recording medium, the fixing unit having a fixing roll, a fixing belt that is stretched by the fixing roll, a pressure roll that forms a nip portion where the recording medium passes, between the fixing belt and the pressure roll, a separation unit that separates the fixing belt and the pressure roll from each other, and a cooling unit that blows cooling air to a face of the pressure roll separated by the separation unit when the recording medium is released from the nip portion and a fixing operation is stopped, the face being opposed to the fixing member, and the cooling unit blowing the cooling air from the upstream side of a portion where the nip portion is formed, wherein the cooling unit further comprises a change unit that changes a blowing direction of the cooling air at the time of the fixing operation.

9. The image forming apparatus according to claim 8, wherein the cooling unit is a blower that blows air.

10. The image forming apparatus according to claim 8, further comprising a controller that controls the cooling unit on the basis of temperature of the face of the pressure roll in the fixing unit, the face being opposed to the fixing belt.

11. The image forming apparatus according to claim 8, wherein the cooling unit is a blower that blows air, and the image forming apparatus further comprises a controller that controls air blown from the blower of the cooling unit on the basis of temperature of the face of the pressure roll in the fixing unit, the face being opposed to the fixing belt.

12. A fixing method for fixing a toner image transferred onto a recording medium, the fixing method comprising:

causing the recording medium where the toner image is transferred to pass through a nip portion formed between a fixing member and a pressure member;

separating the fixing member and the pressure member from each other after the recording medium passes through the nip portion; and blowing cooling air to a face of the pressure member after the separation by a cooling unit when the recording medium is released from the nip portion and a fixing operation is stopped, the face being opposed to the fixing member, and the cooling air being blown from the upstream side of a portion where the nip portion is formed, wherein the cooling unit further comprises a change unit that changes a blowing direction of the cooling air at the time of the fixing operation.

13. An image forming method comprising:

forming a toner image;

transferring the toner image onto a recording medium; and causing the recording medium where the toner image is transferred to pass through a nip portion formed between a fixing member and a pressure member;

separating the fixing member and the pressure member from each other after the recording medium passes through the nip portion; and blowing cooling air to a face of the pressure member after the separation by a cooling unit when the recording medium is released from the nip portion and a fixing operation is stopped, the face being opposed to the fixing member, and the cooling air being blew from the upstream side of a portion where the nip portion is formed, wherein the cooling unit further comprises a change unit that changes a blowing direction of the cooling air at the time of the fixing operation.

14. The fixing device according to claim 1, wherein the blowing direction of cooling air at the time of the fixing operation is different from a blowing direction of cooling air at the time when the fixing member and the pressure member are separated by the separating unit.

15. The image forming apparatus according to claim 8, wherein the blowing direction of cooling air at the time of the fixing operation is different from a blowing direction of cooling air at the time when the fixing belt and the pressure roll are separated.

16. The fixing method for fixing a toner image transferred onto a recording medium according to claim 12, wherein the blowing direction of cooling air at the time of the fixing operation is different from a blowing direction of cooling air at the time when the fixing member and the pressure member are separated.

17. The image forming method according to claim 13, wherein the blowing direction of cooling air at the time of the fixing operation is different from a blowing direction of cooling air at the time when the fixing member and the pressure member are separated.

* * * * *